US010207279B2

(12) United States Patent
Hunt et al.

(10) Patent No.: US 10,207,279 B2
(45) Date of Patent: Feb. 19, 2019

(54) SAND SEPARATOR VESSEL PERFORATED REPLACEABLE INSERT APPARATUS AND METHOD

(71) Applicant: Andritz Inc., Glens Falls, NY (US)

(72) Inventors: Tyson B. Hunt, Saratoga Springs, NY (US); Alexandre David, Curitiba (BR)

(73) Assignee: Andritz Inc., Glens Falls, NY (US)

( * ) Notice: Subject to any disclaimer, the term of this patent is extended or adjusted under 35 U.S.C. 154(b) by 344 days.

(21) Appl. No.: 15/337,247

(22) Filed: Oct. 28, 2016

(65) Prior Publication Data

US 2017/0128958 A1 May 11, 2017

Related U.S. Application Data

(60) Provisional application No. 62/251,302, filed on Nov. 5, 2015.

(51) Int. Cl.

| | |
|---|---|
| ***B04C 5/181*** | (2006.01) |
| ***B04C 5/04*** | (2006.01) |
| ***B04C 5/085*** | (2006.01) |
| ***D21C 11/00*** | (2006.01) |
| ***D21D 5/24*** | (2006.01) |
| ***D21F 1/62*** | (2006.01) |

(52) U.S. Cl.

CPC ..... *B04C 5/181* (2013.01); *B04C 5/04* (2013.01); *B04C 5/085* (2013.01); *D21C 11/00* (2013.01); *D21D 5/24* (2013.01); *D21F 1/62* (2013.01)

(58) Field of Classification Search

CPC ..... B04C 5/181; B04C 5/04; B04C 5/085; D21C 11/00; D21D 5/24; D21F 1/62

See application file for complete search history.

(56) References Cited

U.S. PATENT DOCUMENTS

| | | | | |
|---|---|---|---|---|
| 2,998,137 A * | 8/1961 | Vane | B01D 29/11 209/17 |
| 4,280,902 A * | 7/1981 | Jacobsen | B04C 5/085 209/731 |
| 2003/0201213 A1* | 10/2003 | Bolles | B04C 5/13 209/725 |

* cited by examiner

*Primary Examiner* — David A Reifsnyder

(74) *Attorney, Agent, or Firm* — Robert Joseph Hornung

(57) ABSTRACT

A perforated replaceable insert for a sand separator vessel in a digester feed system where the perforations have at least a width and a length. The perforations are aligned columns and rows, with the columns being positioned to be parallel to a line formed by the tangent of the conical axis.

17 Claims, 9 Drawing Sheets

SAND SEPARATOR VESSEL PERFORATED REPLACEABLE INSERT APPARATUS AND METHOD

CROSS RELATED APPLICATION

This application is a non-provisional application claiming the benefit of U.S. Prov. Pat. App. Ser. No. 62/251,302, filed Nov. 5, 2015, the entirety of which is incorporated by reference herein.

BACKGROUND OF THE INVENTION

Aspects of the disclosure relate generally to problems caused by separating and removing harmful material, such as but not limited to sand, in the fiber line of a chemical pulp mill during production of chemical pulp. Specifically, equipment and methods to remove sand from the recirculation liquor of the fiber line (digester) feed system are disclosed.

Comminuted cellulosic fiber material treated in a conventional pulp production process, e.g. wood chips, biomass, or other comminuted cellulosic material (for convenience referred to here as "chips") typically contain non-cellulosic harmful material. The non-cellulosic harmful material includes sand, dirt, stones, different pieces of metal, (e.g. nails, pieces of metal wire, or bolts and nuts), chips of metal, or other heavy cellulosic materials (e.g. knots). The density of this non-cellulosic harmful material is typically at least 10% higher than the density of the cellulosic material being treated (e.g. at least 50% higher). Much of this non-cellulosic harmful material can be removed during the process of producing the chips for feeding to the pulping process, but part of the non-cellulosic harmful material will be passed into the digester feed system, to an optional impregnation vessel, and to the digester itself.

In many existing digester feed systems, smaller non-cellulosic harmful material such as sand, dirt, stones, etc., remain with the recirculation liquor used within the digester feed system. For simplicity purposes, the term "sand" is used throughout this document to mean smaller non-cellulosic harmful material previously identified. The recirculation liquor (for convenience referred to here as "liquor") typically is used as transport liquor in digester feed systems having low pressure feeders, high pressure feeders, chip pumps, slurry pumps, or similar equipment where liquor may be needed.

Liquor within the digester feed system may have many functions and many sources. For clarity purposes, "entrained liquor" in this disclosure refers to liquor fed to the sand separator vessel and contains sand and even other solid particles.

The liquor is recirculated within the digester feed system to assist or improve the transport of chips in the digester feed system. Liquor may be any suitable sort of liquid, including but not limited to fresh water, fresh cooking liquor, black liquor, green liquor, recirculated liquor, cooking solution, or any combination thereof.

Usually sand is separated from the liquor in the digester feed system by means of some sort of separator. A conventional sand separator vessel removes sand and other solid particles from the entrained liquor circulated via a chip conveyor arrangement at the digester plant. U.S. Pat. No. 4,280,902 describes a cyclone-type sand separating device for removing undesirable solid particles, especially sand, from the debris-laden, or entrained liquor. Removal of solid particles, particularly sand, from the entrained liquor results in an essentially sand free (cleaned) liquor. The essentially sand free (cleaned) liquor may then be returned and become a part of the liquor of the digester feed system. For simplicity, the solid particles removed from the entrained liquor will be referred to as "sand," although other undesirable solid particles may also be present.

A sand separator vessel typically is generally cylindrical in shape, typically with an upper section and a lower section, and comprises a tangential inlet into a cylindrical container. The cylindrical container is generally comprised of an upper section, generally having a cylindrical shape, and a lower section, generally having a cone or conical shape. In this document the upper section of the cylindrical container may also be referred to as a "cylindrical portion." In such devices, the debris laden liquor is introduced into an upper section of the cylindrical container, and a forceful whirling motion is generated within the cylindrical portion. Sand, separated out of the entrained liquor and driven by gravitational and centrifugal forces, is forced downward in the cylindrical portion into a lower section, which may be a separating chamber, usually having a conical shape. From the lower section or separating chamber, the sand is discharged.

Within the lower section or separating chamber is located a funnel-shaped replaceable insert. For simplicity, in this application the term "replaceable insert" and "insert" may be used interchangeably. The replaceable insert has openings to allow sand to pass through the replaceable insert into the solid particle collection region (collection region) and ultimately out of the sand separator vessel.

The location of the replaceable insert within the sand separator vessel is at a level to prevent vertical stagnation of sand while having minimal disruption of the whirling motion. An outlet for the essentially sand-free (cleaned) liquor is located in the upper part of the cylindrical portion.

Typically, replaceable inserts are perforated metal pieces shaped like a funnel. The perforations may be vertical slots or circular holes and may extend the entire surface of the replaceable insert. Replaceable inserts are attached to the inner wall of the lower section of the sand separator vessel (within the separating chamber). As the entrained liquor enters the sand separator vessel, the whirling motion within the sand separator vessel separates the liquid and solid particles (sand) within the entrained liquor. Sand moves downward to the lower section, resulting in a strong whirling flow with complex flow patterns through the openings in the replaceable insert and eventually out a discharge of the sand separator vessel.

The replaceable insert is typically conical (or funnel) in shape with a large opening at one end and a small opening at the opposite end. Generally the replaceable insert is attached at the large opening end to the interior wall of the sand separator vessel in the vertically lower region of the sand separator vessel. A rigid attachment is typically used to connect the replaceable insert to the interior wall of the sand separator vessel.

Several adverse operational conditions have been identified with the sand separator vessel. As a result of the whirling motion and centrifugal and gravitational forces needed to separate the sand from entrained liquor, replaceable inserts become damaged and can collapse in on themselves. Additionally, uneven wear of the replaceable insert is experienced.

Uneven wear results in some sections of the replaceable insert being completely absent while other sections remain intact. Where the replaceable insert is worn through (or absent), sand may violently contact the collection region wall on the interior of the sand separator vessel and cause erosion which leads to material thinning, weak spots, and eventually holes, in the sand separator vessel.

Undesirable and complex flow patterns of the sand within the replaceable insert exist causing adverse operational conditions such as the clogging of openings in the replaceable insert. The undesirable flow patterns cause sections or regions of very high sand particle velocities within the replaceable insert where the openings in the replaceable insert become overwhelmed and clog.

These adverse operational and uneven wear conditions at some point in time require the sand separator vessel to be taken offline and the replaceable insert repaired or replaced. There is a long felt need to provide a replaceable insert more readily capable of withstanding gravitational and centrifugal forces, undesirable sand flow patterns and velocities, as well as the abrasive attack of the sand moving within the replaceable insert. It is to these needs and others that the present disclosure is directed.

BRIEF DESCRIPTION OF THE INVENTION

A perforated replaceable insert for a sand separator vessel in a digester feed system has been conceived. The conceived perforated replaceable insert reduces the uneven wear problems previously experienced. Additionally, the conceived perforated replaceable insert is capable of withstanding centrifugal forces, thereby eliminating the problems associated with the collapse of the perforated replaceable insert, i.e., the perforated replaceable insert collapsing onto itself.

In addition, a perforated replaceable insert has been conceived to provide a smooth and consistent movement of sand particles in a downward direction and through the surface of the perforated replaceable insert along the entire vertical length of the perforated replaceable insert. The smooth, consistent movement of sand particles prevents an undesirable accumulation of sand near the lower end of the insert where sand might cause clogging and sporadic movement. The smooth and consistent movement of sand particles through the perforated replaceable insert overcomes certain operational problems of a sand separator vessel.

DETAILED DESCRIPTION OF THE INVENTION

The foregoing will be apparent from the following more particular description of exemplary embodiments of the disclosure, as illustrated in the accompanying drawings. The drawings are not necessarily to scale, with emphasis instead being placed upon illustrating the disclosed embodiments.

Except as otherwise expressly provided herein, the following rules of interpretation apply to this specification (i.e., written description, claims, abstract and/or drawings): (a) all words used herein shall be constructed to be of such gender or number (singular or plural) as the circumstances require; (b) the singular terms "a," "an," and "the," as used in the specification and the appended claims include plural references unless the context clearly dictates otherwise; (c) the antecedent term "about" applied to a recited range or value denotes an approximation within the deviation in the range or value known or expected in the art from the measurements method; (d) the words "herein," "hereby," "hereof," "hereto," "hereinbefore," and "hereinafter," and words of similar import, refer to this specification in its entirety and not to any particular paragraph, claim or other subdivision, unless otherwise specified; (e) descriptive headings are for convenience only and shall not control or affect the meaning or construction of any part of the specification; and (f) "or" and "any" are not exclusive and "include" and "including" are not limiting. Further, the terms "comprising," "having," "including," and "containing" are to be construed as open-ended terms (i.e., meaning including, but not limited to,") unless otherwise noted.

Although this disclosure describes in context a sand separator vessel in association with a digester feed system (also known as a fiber line feed system), it is understood that this disclosure is applicable to other separation devices where whirling action and gravitational and centrifugal forces are used to separate an entrained liquor, i.e., liquid or liquor entrained with solid particles, into a solid particle stream and a relatively clean liquid or liquor stream.

When appropriate and to provide clarity, similar reference numbers between figures are used to signify similar equipment.

Figure 1:
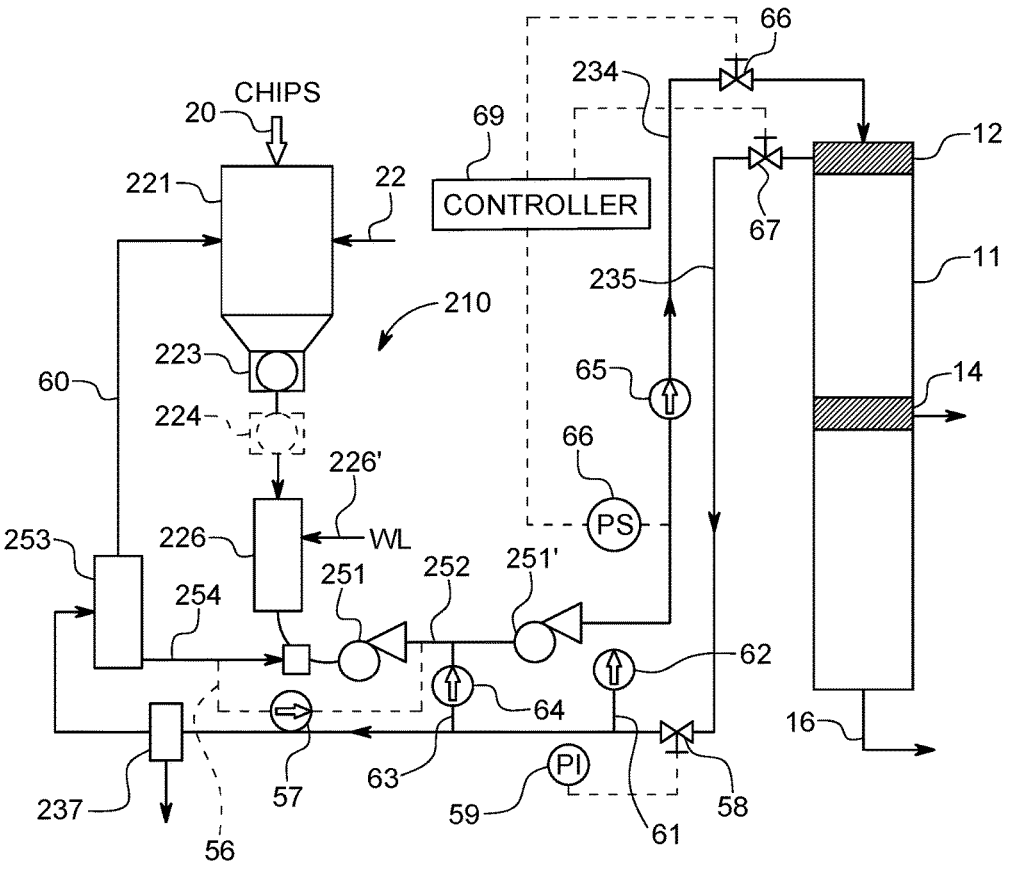
FIG. 1 PRIOR ART
FIG. 1 illustrates placement of a sand separator vessel within a digester feed system using high-pressure suspension pumps, prior art.

FIG. 1 illustrates a prior art digester feed system showing a recirculation loop connected to a digester or an impregnation vessel, which is known from e.g. U.S. Pat. No. 5,753,075. In the system of the '075 patent, chips are transferred by means of at least one, preferably two high-pressure suspension pumps 251, 251' for conveying the chips to the inlet of the digester 11 instead of a high-pressure feeder. It is also possible to use other pressurizing and transferring means such as high pressure feeders (HPF, well-known in the industry) in place of the high-pressure suspension pumps 251, 251'.

The chips 20 are introduced into a steaming vessel 221, which receives steam through one or more steam conduits 22. Steamed chips from the steaming vessel 221 are fed into a metering device 223, which may be a pocketed rotor or a screw-type device or other suitable metering device.

The discharge from the metering device 223 can be sent to an isolating device 224 or can be fed directly into a conduit or chute 226. If used, the isolating device 224 may be a pressure-isolator, such as a pocketed rotor-type isolator device (also known as a low pressure feeder) arranged between the metering device 223 and the chute 226.

Cooking liquor (also known as white liquor, "WL") is added into the chute 226 via line 226' so that a suspension of chips and liquor is formed (not shown). The suspension is discharged from the chute 226 via a curved outlet 250 to the inlet of the high-pressure suspension pump 251. Typically, the suspension going to the inlet of the high-pressure suspension pump 251 is augmented with liquor coming from a liquor tank 253 through digester feed conduit 254.

Though the embodiment illustrated in FIG. 1 has two high-pressure suspension pumps, alternatively only a single high-pressure suspension pump can be used, or two or more high-pressure suspension pumps connected in series or parallel can be used.

The pressurized and typically heated suspension is discharged from the high-pressure suspension pump 251' to a digester feed conduit 234. The digester feed conduit 234 conveys the suspension into the inlet of a continuous digester 11. Excess liquor is removed from the suspension in a conventional way via a screen 12. Extraction of black liquor from the digester 11 may also occur through screen 14. The black liquor from screen 14 may be further processed. Cooked chips (pulp) 16 are discharged from digester 11 and processed further downstream of the high-pressure suspension pump digester feed system 210.

The excess liquor removed from the suspension is returned to the high-pressure suspension pump digester feed system 210 via a return conduit 235, preferably into the liquor tank 253 to be used in the formation of the suspension of chips and liquor in a conduit 250 through digester feed conduit 254. Liquor in return conduit 235 may contain sand particles. If desired, the liquor in return conduit 235 can be conveyed through a sand separator vessel 237 designed for pressurized or non-pressurized use according to the desired operational mode.

Figure 2:
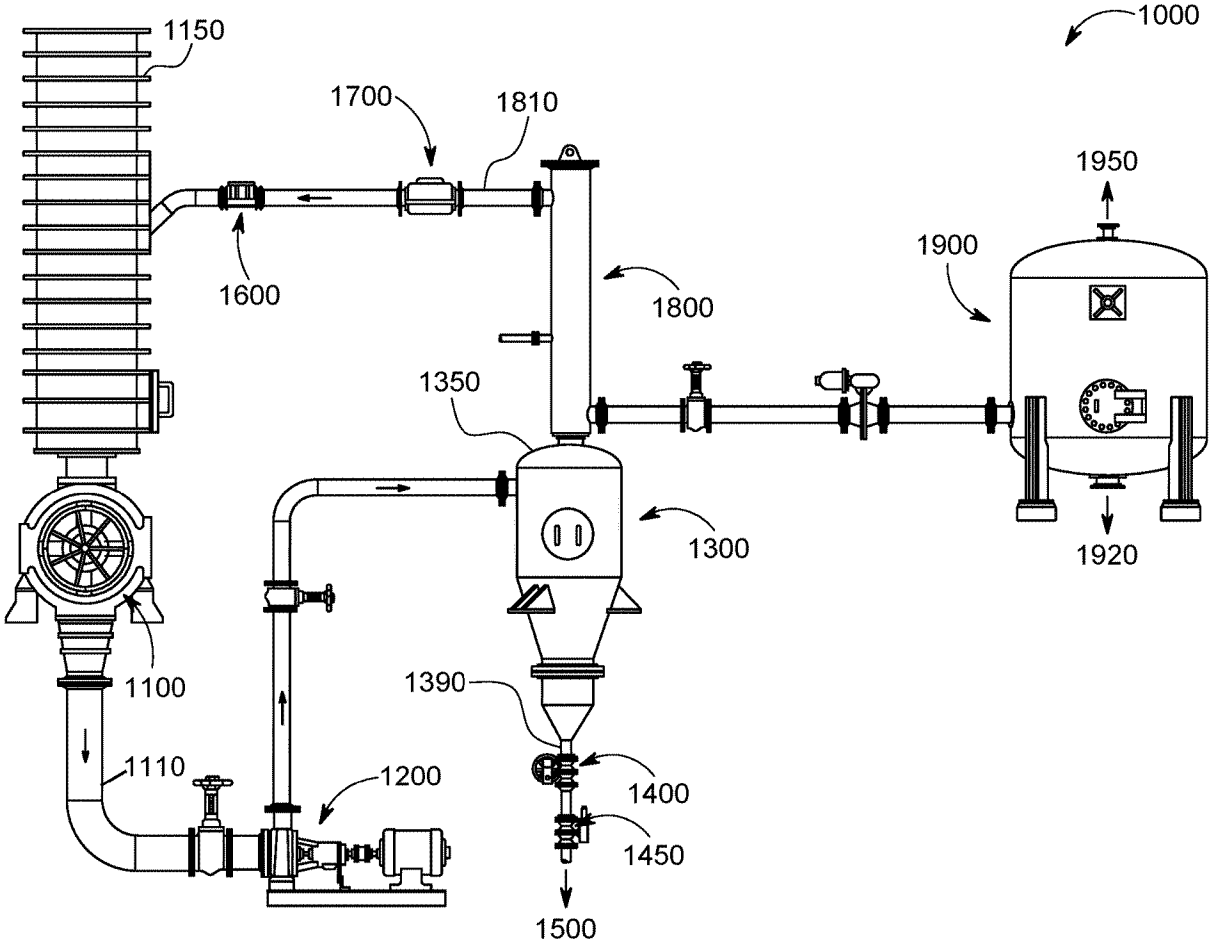
FIG. 2 PRIOR ART
FIG. 2 illustrates placement of a sand separator vessel within a digester feed system using a high-pressure feeder (HPF), prior art.

If a HPF is used in place of the high-pressure suspension pumps, returning the pressurized liquor of return conduit 235 to the inlet of the high-pressure suspension pumps 251, 251' is not essential for the operation of the arrangement of FIG. 1. The energy available from the flow in return conduit 235 can be used at any point in the chemical pulp mill as required. FIG. 2 illustrates a digester feed system using a HPF.

If the chute 226 is operated essentially at atmospheric pressure, the returned liquor in return conduit 235 is to be returned to essentially atmospheric pressure prior to feeding it into conduit 250. One way of accomplishing this is to use a pressure regulation valve 58 and a pressure detector 59 in return conduit 235.

The opening of the pressure regulation valve 58 is controlled so that a predetermined, lower pressure prevails in return conduit 235 downstream of the pressure regulation valve 58. Additionally, the liquor tank 253 can be designed so that it operates as a "flashing tank" so that the hot pressurized liquor in return conduit 235 is quickly evaporated to be used as a steam source e.g. in steaming vessel 221 via steam conduit 60.

Preferably the pressurized liquor in return conduit 235 is used for augmenting the flow exiting from high-pressure suspension pump 251', through augment conduit 61 and augment conduit pump 62. An option is to use the pressurized liquor in return conduit 235 to augment the flow between high-pressure suspension pumps 251 and 251' in pump connector conduit 252 through pump augment conduit 63, using or not using pump augment pump 64. If necessary, liquor from digester feed conduit 254 may be used to augment the flow in pump connector conduit 252. Liquor from digester feed conduit 254 may be added to pump connector conduit 252 via liquor tank augment conduit 56 and liquor tank augment pump 57.

FIG. 1 illustrates a one-way (check) valve 65 (this valve may be a check valve or any other suitable valve) located in digester feed conduit 234. This one-way (check) valve 65 prevents pressurized flow from returning to high-pressure suspension pump 251 or 251'. In addition, conventional automatic (e.g. solenoid operated) inlet isolation valve 66 and return isolation valve 67 are located in digester feed conduit 234 and return conduit 235, respectively, to isolate the digester feed conduit 234 and return conduit 235 from the rest of the high-pressure suspension pump digester feed system 210. Digester feed conduit 234 and return conduit 235 may contain pressurized liquor.

In one mode of operation, a conventional pressure switch 68 is located downstream of high-pressure suspension pump 251' in digester feed conduit 234. The pressure switch 68 is used to monitor the pressure in digester feed conduit 234 so if the pressure deviates from a predetermined value, the conventional pressure controller 69 will automatically isolate digester 11 from the high-pressure suspension pump digester feed system 210. This isolation results by automatically closing inlet isolation valve 66 and return isolation valve 67.

FIG. 2 illustrates a section of a HPF digester feed system 1000 having a HPF 1100 connected to the sand separator vessel 1237 via low pressure outlet liquor conduit 1110. Low pressure outlet conduit 1110 may include a chip chute pump 1200 to provide pressurization for the liquor from the HPF 1100 to be fed to the sand separator vessel 1237. Liquor within the low pressure outlet conduit 1110 may include sand which, if not removed, causes significant damage to the process equipment (vessel, conduits, pumps, etc.) of the HPF digester feed system 1000 and the processing equipment upstream.

Liquor containing sand (entrained liquor) from the low pressure outlet conduit 1110 is introduced tangentially into the sand separator vessel 1237 near the vertical top of the vessel. By means of centrifugal forces, the sand is separated from the entrained liquor and leaves the sand separator vessel 1237 via the bottom of the sand separator vessel 1237. The term "bottom" here means the vertically lower end of a vessel, the vessel having a top located vertically above its bottom.

Typically the sand leaves the sand separator vessel 1237 out of the bottom, passing through a ball valve 1400 and a pocket valve 1450 to disposal 1500. Essentially sand free (cleaned) liquor 1330 is released through the top discharge 1350 and may be sent to the level tank 1900 or the in-line drainer 1800 and returned to the chip chute 1150 via low pressure liquor recirculation conduit 1810 through flow meter 1700 and check valve 1600.

The level tank 1900 may also have a steam stream removed via a level tank top outlet 1950 to the steaming vessel (not shown). Additionally, level tank 1900 may include a level tank bottom discharge 1920 for liquor is discharged to the make-up liquor pump (not shown) elsewhere in the HPF digester feed system 1000.

Figure 3:
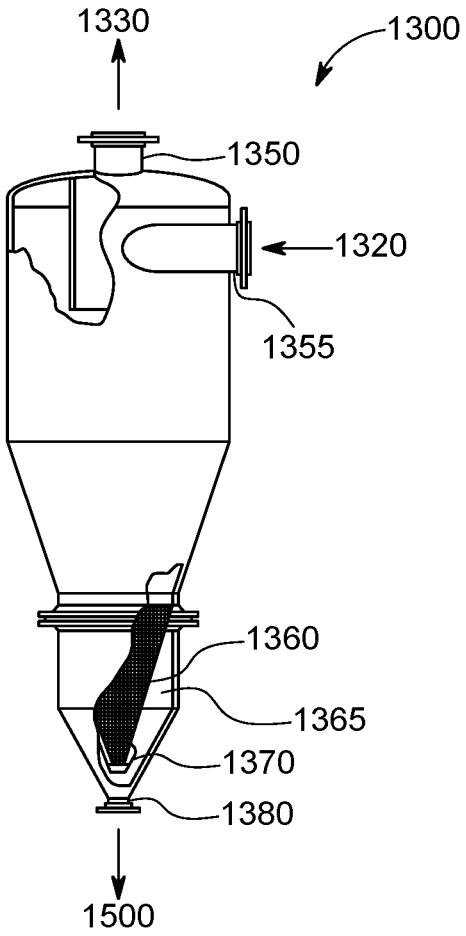
FIG. 3 PRIOR ART
FIG. 3 is a schematic of a sand separator vessel for a digester feed system, prior art.

FIG. 3 shows a typical sand separator vessel 1237. Sand separator vessel 1237 is shown as a vertically oriented mostly cylindrical vessel, having a top and a bottom. The bottom being vertically lower than the top of the vessel.

Debris laden liquor 1320 (i.e. liquor having sand particles trapped and carried along with the liquor) enters the sand separator vessel 1237 at the tangential inlet 1355. Typically the tangential inlet 1355 is located in the vertically upper region of the sand separator vessel 1237. Upon entering the sand separator vessel 1237, entrained liquor 1320 is forced into a whirling motion within the sand separator vessel 1237.

The whirling motion within the sand separator vessel 1237 causes the sand to separate from the liquor. Once separated, sand is moved by gravitational and centrifugal forces downward through the sand separator vessel 1237 through a replaceable insert 1360 in the bottom region of the sand separator vessel 1237.

The sand, having passed through the replaceable insert 1360, is collected in a sand collection region 1365. The sand collection region 1365 may also be referred to as a solids particle collection region or collection region. Sand is removed from the sand separator vessel 1237 through a sand discharge 1380 and is sent to disposal 1500.

To break or otherwise stop the whirling motion of the sand prior to discharge through the sand discharge 1380, the whirling sand is sent through a vortex breaker 1370. The vortex breaker 1370 may have a replaceable insert 1360, or may be attached to the replaceable insert 1360 at the discharge end of the replaceable insert 1360.

Figure 4:
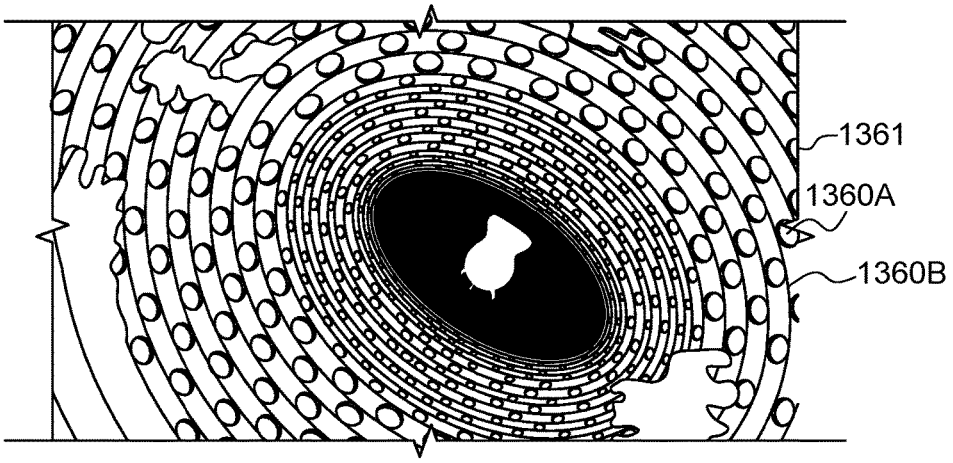
FIG. 4 PRIOR ART
FIG. 4 shows a holed replaceable insert for a sand separator vessel, prior art.

FIG. 4 shows a conventional holed replaceable insert 1361, i.e., a replaceable insert with holes of conventional design. The conventional holed replaceable insert 1361 is comprised of a metal plate shaped to fit within the vertically lower region of a sand separator vessel 1237. Circular holes 1360A are made in the metal plate and have land areas 1360B between the holes 1360A.

The holes 1360A are located about the entire surface of the conventional holed replaceable insert 1361 and are of a single size sufficient to allow the sand to pass through the holes 1360A from the interior of the conventional holed replaceable insert 1361 surface to the sand collection region 1365 (shown in FIG. 3) surrounding the replaceable insert 1360 (shown in FIG. 3). The holes 1360A are typically 3/8 inch diameter on 1 inch spacings, and are small enough to prevent any chips from either passing through or becoming lodged in the hole 1360A, but are large enough for sand to pass through. The location of the holes is not determined by a specific pattern. Sand is collected in the sand collection region 1365 for discharge from the sand separator vessel 1237.

Figure 5:
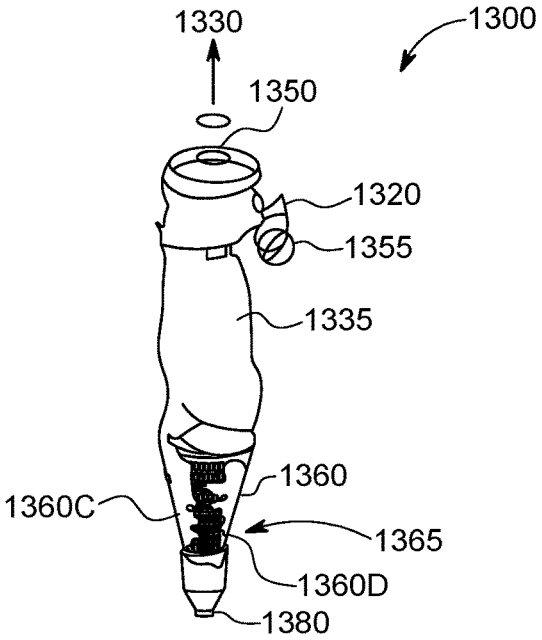
FIG. 5 PRIOR ART
FIG. 5 shows the flow of material within the sand separator vessel, prior art.

FIG. 5 shows a typical sand separator vessel 1237. Debris laden liquor 1320 enters the sand separator vessel 1237 near the vertical top of the vessel through the tangential inlet 1355. The whirling mass of sand 1335 is shown moving vertically downward within the sand separator vessel 1237 A conventional replaceable insert 1360 is shown with vertical slots 1360C in the metal plate and land areas 1360B between the vertical slots 1360C.

Sand accumulates within the sand collection region 1365 prior to passing through the sand discharge 1380. Essentially sand free (cleaned) liquor 1330 is removed through the top discharge 1350 of the sand separator vessel 1237.

Figure 6:
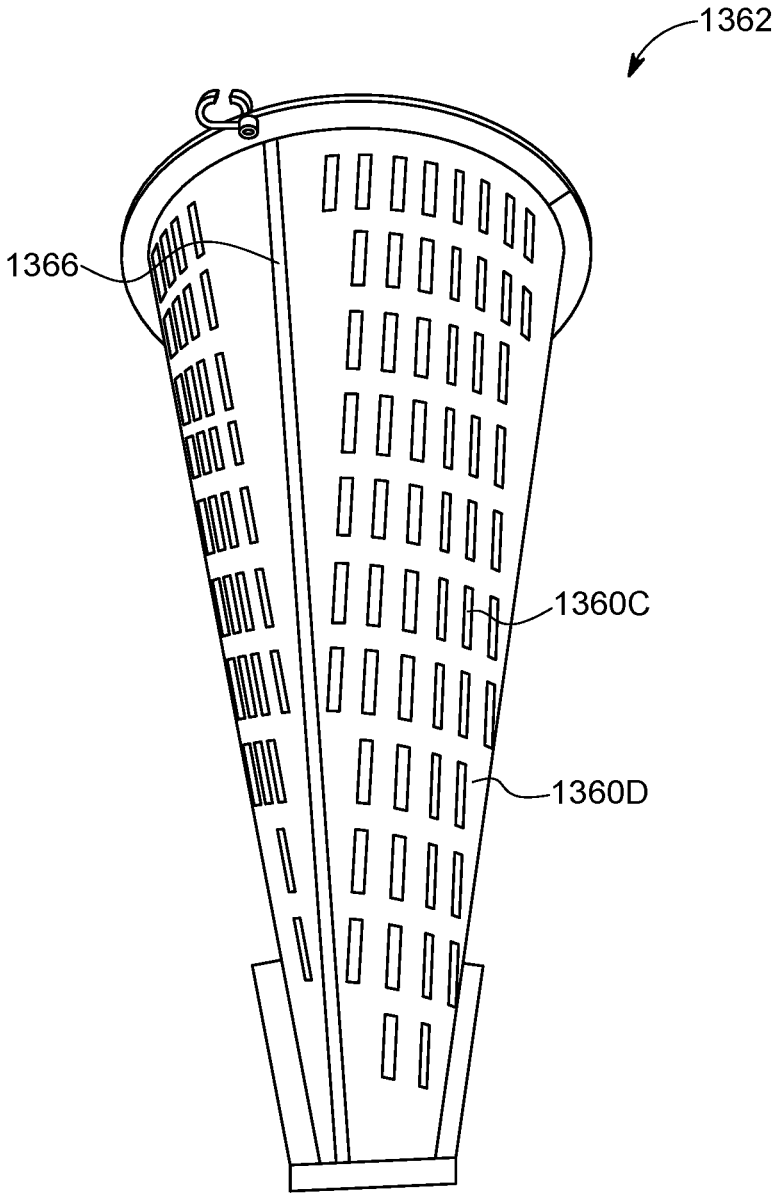
FIG. 6 PRIOR ART
FIG. 6 shows a slotted replaceable insert for a sand separator vessel, prior art.

FIG. 6 shows a conventional slotted replaceable insert 1362, as depicted in FIG. 5. Also shown in FIG. 6 are the vertical slots 1360C and the land areas 1360B between the vertical slots 1360C. Vertical slots 1360C typically have a width dimension of 8 mm and a length of 72 mm.

A vertical slot 1360C width of 8 mm allows the cross section of the slot to be reduced by 20%, when compared to the diameter of the holes 1360A. Such a reduction in width dimension is desirable to prevent the passage of chips through the vertical slot 1360C or blockage of the vertical slots 1360C by chips.

A vertical slot 1360C length of 72 mm allows the vertical slots 1360C to be reduced in number (compared to holes 1360A), thereby increasing the distance between vertical slots 1360C (the distance between the vertical slots 1360C is measured center line to center line of the vertical slots 1360C). By increasing the distance between vertical slots 1360C, the conventional slotted replaceable insert 1362 has more sufficient land area 1360D (also referred to as blank area) than exists in conventional holed replaceable inserts 1361. It is important to increase the land area 1360D of the replaceable insert to obtain a conventional slotted replaceable insert 1362 less susceptible to erosion than the conventional holed replaceable insert 1361.

The manufacturing process of both the conventional holed replaceable insert 1361 and the conventional slotted replaceable insert 1362 requires use of a flat piece of metal plate. While flat, the openings, holes, or slots, are made in the metal plate without any specific pattern or arrangement.

Once the openings are made, the metal plate is formed into the replaceable insert 1360. Where the ends of the metal plate meet, a seam 1366 exists. The seam 1366 may be formed by welding the metal ends together or another acceptable method may be used to attach and secure the metal end pieces to each other.

Figure 7:
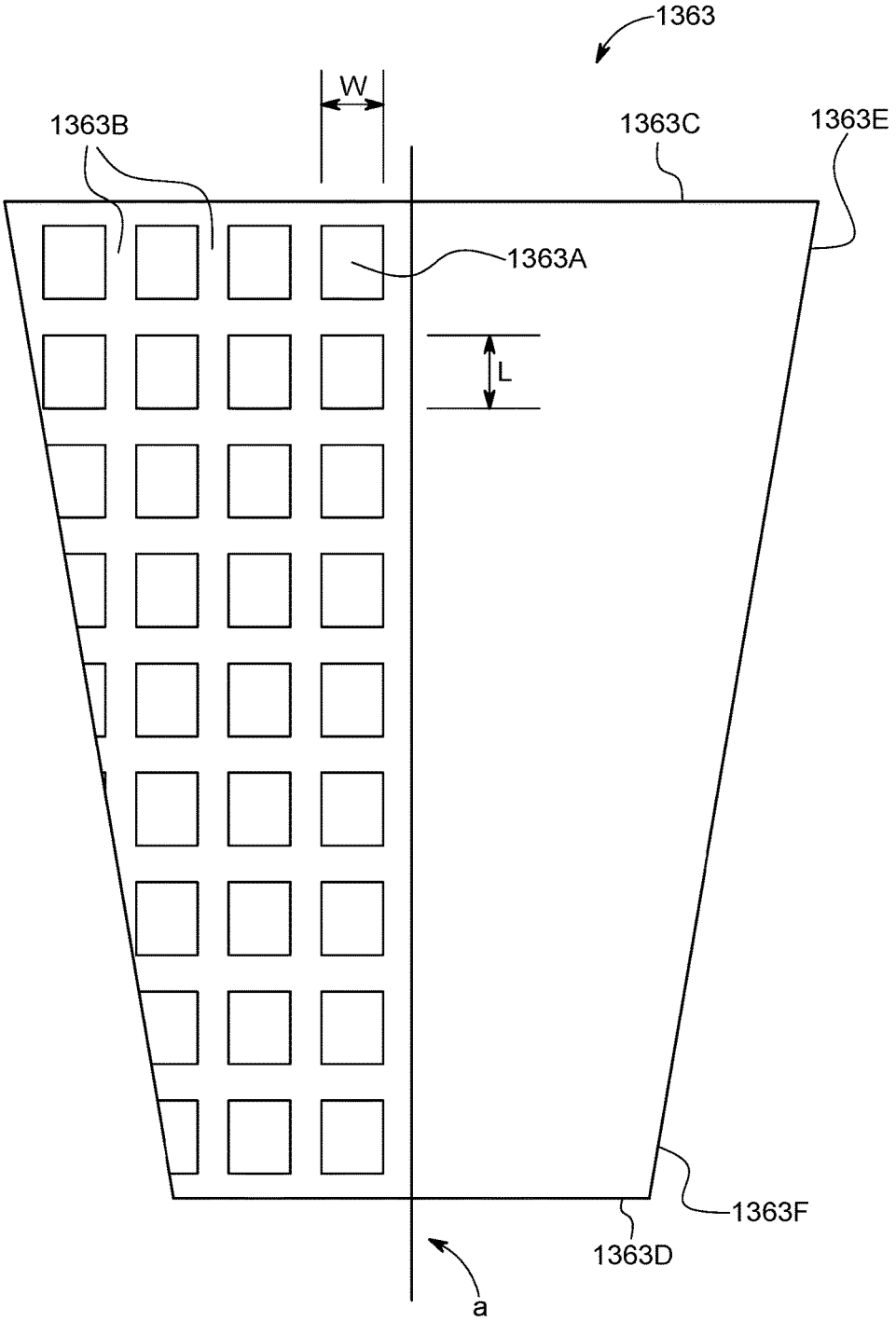
FIG. 7 shows a perforated replaceable insert for a sand separator vessel with slots having a vertical orientation and columns of slots that are parallel to the tangent of the conical axis, according to an embodiment of the current application.

FIG. 7 shows a perforated replaceable insert 1363 according to an embodiment of this disclosure. The perforations of the perforated replaceable insert 1363 are vertical slots 1363A. The vertical slots 1363A are positioned in columns and rows on the perforated replaceable insert 1363.

Orientation of the columns of vertical slots 1363A may be parallel to line "a" such that the line "a" is the tangent of the conical axis of the perforated replaceable insert 1363. This parallel orientation is necessary for sand removal through the vertical slots 1363A as the sand moves in a whirling motion based on the conical shape of the perforated replaceable insert 1363. By having the vertical slots 1363A align in columns parallel to line "a," the centrifugal force imparted on the sand passing the vertical slots 1363A will direct the sand into the vertical slots 1363A.

The centrifugal forces acting on the sand provide a pattern of flow of the sand within the slotted replaceable insert. By recognizing the pattern of flow of the sand and locating the vertical slots 1363A in the pattern following the pattern of the centrifugal forces the individual sand particles are moved to the vertical slots 1363A by the centrifugal force existing in the sand separator. By providing vertical slots 1363A in the suggested pattern, more sand will fall into the openings rather than hitting the surface of the metal. Sand hitting the surface of the metal results in wear of the metal. The vertical slots 1363A, provided in the suggested pattern results in an extension of the life of the perforated replaceable insert 1363.

Columns of vertical slots 1363A extend in a vertical line from essentially the top 1363C of the perforated replaceable insert 1363 to the bottom 1363D. The vertical slots 1363A may all be of the same length "L" and width "W" throughout the perforated replaceable insert. Typically, the width "W" of the vertical slots 1363A is 6 mm or less, for example 4 mm or 2 mm, to prevent wood pieces, pulp fibers, or matter other than sand from passing through the slots. Vertical slots 1363A typically have a length "L" being no more than 72 mm. The measurements of the length and width or the ratio of length to width should be suitable to prevent wood pieces, pulp fibers, or matter other than sand from passing through the slots. For example, one such advantageous ratio of length to width may be 12:1, or a length of 48 mm and a width of 4 mm. As another example, a length of 36 mm and width of 3 mm can be used, such that the length of a slot may be set using a desired width, based on the raw material to the digester feed system, such that wood pieces, pulp fiber, or matter other than sand are prevented from passing through the slots. By maintaining the width "W" below 6 mm, less pin chips or fins are removed with the sand from the entrained liquor.

It is desirable to separate the sand from the entrained liquor while maintaining the pin chips and fines within the entrained liquor. A vertical slot 1363A having a width of 6 mm or less, for example 4 mm or less, or 2 mm or less, will prevent the pin chips and fines from passing through or blocking the vertical slots 1363A with the sand particles. In one embodiment, a vertical slot 1363A having a width of no more than 6 mm is used along with a correspondingly desirable vertical slot 1363A size where the vertical slot 1363A allows for sand to pass through and allows for sufficient rows and columns of slots to provide the needed open space for the passage of sand.

In one exemplary embodiment, a vertical slot 1363A has a width of no more than 6 mm and a length of no more than 72 mm, or a corresponding ratio, and the sand collection region 1365 is protected from the less desirable chip pins and fines passing through the vertical slots 1363A and into the sand collection region 1365. Chip pins and fines are particles which have been processed through a digester or impregnator and contain abrasive cooking liquor within the particles. It is desirable for the chip pins and fines to remain with the essentially sand free (cleaned) liquor portion of the separated entrained liquor and to return to the process for further treatment. Reducing the passage of chip pins and fines into the sand collection region 1365, provides additional space for sand collection as well as reduces the likelihood of possible corrosion of the sand separator vessel 237 or 1237 within a digester feed system as shown in FIGS. 1 and 2, from liquor within the chip pins and fines.

Between the vertical slots 1363A are land areas 1363B. Land areas 1363B are necessary to provide structural support for the perforated replaceable insert 1363. Land areas may 1363B comprise between about 75% to about 95%, of the surface area of the metal to provide sufficient structural support and prevent the perforated replaceable insert from collapsing in on itself. Providing sufficient structural support by the use of the land areas 1363B, results in increased life of the perforated replaceable insert 1363. Additionally, a high percentage of land area 1363B enhances the protection of the sand collection region 1365 by reducing or eliminating the likelihood of the perforated replaceable insert 1363 collapsing.

Additionally, the metal plates used to form the perforated replaceable insert may wear unevenly due to the abrasive nature of sand. To overcome the uneven wear pattern experienced by a conventional replaceable insert, one embodiment of the perforated replaceable insert of the present disclosure comprises a hard coating applied to the metal plate surface, and another embodiment comprises a metal plate having an increased thickness.

The top of the metal plate, for example, the top 20% to 40%, 25% to 35%, 20% to 30%, or even 25% to 30% of the metal plate, may be treated with a hard coating such as tungsten carbide or other suitable material prior to installation. ("Top," in this instance, refers to the widest part of the metal portion at the inlet of the perforated replaceable insert). The hard coating layer ideally does not exceed 0.3 mm in thickness. An example of a suitable process to apply the hard coating is a High Velocity Oxygen Fuel (HVOF) coating process where melted material is sprayed on the surface of the metal plate.

If a hard coating is not used, it is also possible to construct the top of the metal plate, for example, the top 20% to 40%, 25% to 35%, 20% to 30%, or even 25% to 30% of the metal plate with a thicker metal plate, such as 10%, 15%, or 20% thicker, or 2 mm to 8 mm thicker, or 4 mm to 6 mm thicker, for example, than the remaining metal plate.

Regardless of whether a hard coating or thicker metal plate is used, while the rate of metal wear may not be reduced over conventional replaceable inserts, life of the replaceable insert will be extended because uneven wear of the metal plate may be avoided.

Figure 8:
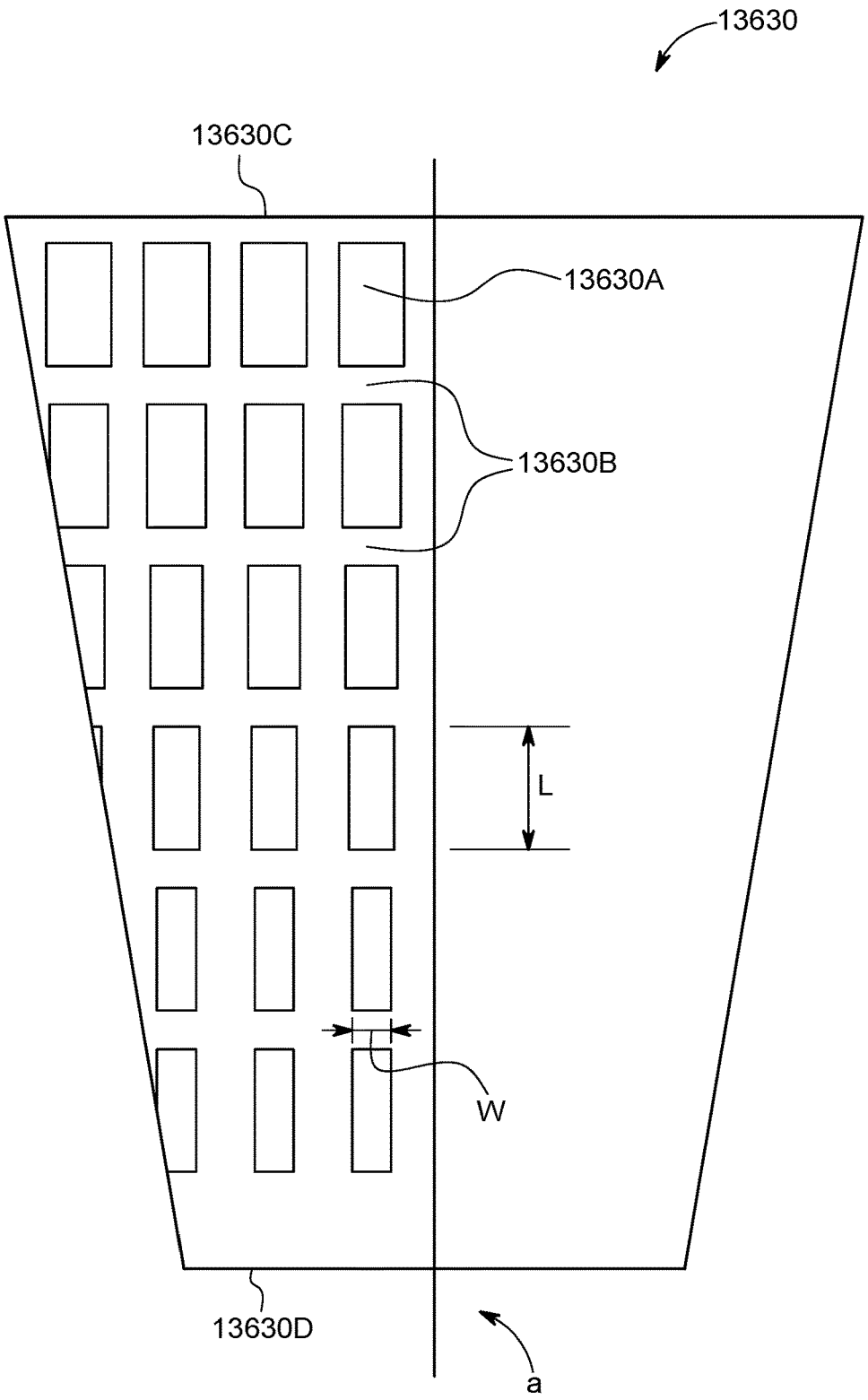
FIG. 8 shows a perforated replaceable insert for a sand separator vessel with slots having a vertical orientation and varying widths, according to an embodiment of the current application.

FIG. 8 shows a perforated replaceable insert 13630 according to another embodiment of this disclosure. The perforations of the perforated replaceable insert 13630 are vertical slots 13630A with land areas 13630B between the vertical slots 13630A. The vertical slots 13630A are positioned in columns and rows on the perforated replaceable insert 13630.

As with vertical slots 1363A of FIG. 7, vertical slots 13630A may be arranged parallel to a line "a" such that the line "a" is the tangent of the conical axis of the perforated replaceable insert 13630. Similarly to vertical slots 1363A of FIG. 7, vertical slots 13630A of FIG. 8 have essentially the same length "L," Unlike FIG. 7, vertical slots 13630A of FIG. 8 do not all have the same width "W."

As the sand moves vertically downward through the perforated replaceable insert 13630 from the top 13630C to the bottom 13630D, the widths "W" of the vertical slots 13630A change. This change may be a wider width "W" at the top 13630C and a narrower width "W" at the bottom 13630D (as shown in FIG. 8). It is also possible for the change in the width "W" of the vertical slots 13630A to gradually change as the sand moves vertically downward, such that the width "W" may not change from row to row or within each row.

In another embodiment the gradual change of the width "W" may occur in sets of rows, for example the first three rows may be a set of rows and the width "W" for each vertical slot 13630A in such set may be the same. Each vertical slot 13630A in a second set of rows, vertically below the first set of rows, may have a different width "W" than the previous set of rows. Other sets of rows may follow and have different widths "W" from the previous set of rows.

In another embodiment, rows of vertical slots 13630A gradually change in width "W" such that the widest vertical slots are at the bottom (rather than the top) and the top row of vertical slots has the narrowest vertical width "W."

Varying the width "W" of the vertical slots may positively impact the sand removal efficiency as larger (or in this case wider) slots are used to offset the velocity and concentration of sand to be removed. Positioning narrower slots near the top of the perforated replaceable insert 13630 where the concentration and velocity of sand is highest may also positively impact removal of sand.

In the case of gradually changing vertical slot width "W" dimension, the largest width "W" should not exceed about 6 mm and the smallest width "W" dimension should not be less than 1 mm. A width "W" dimension as suggested will allow wood pieces, pin chips, fines, or matter other than sand from passing through the vertical slot.

Figure 9:
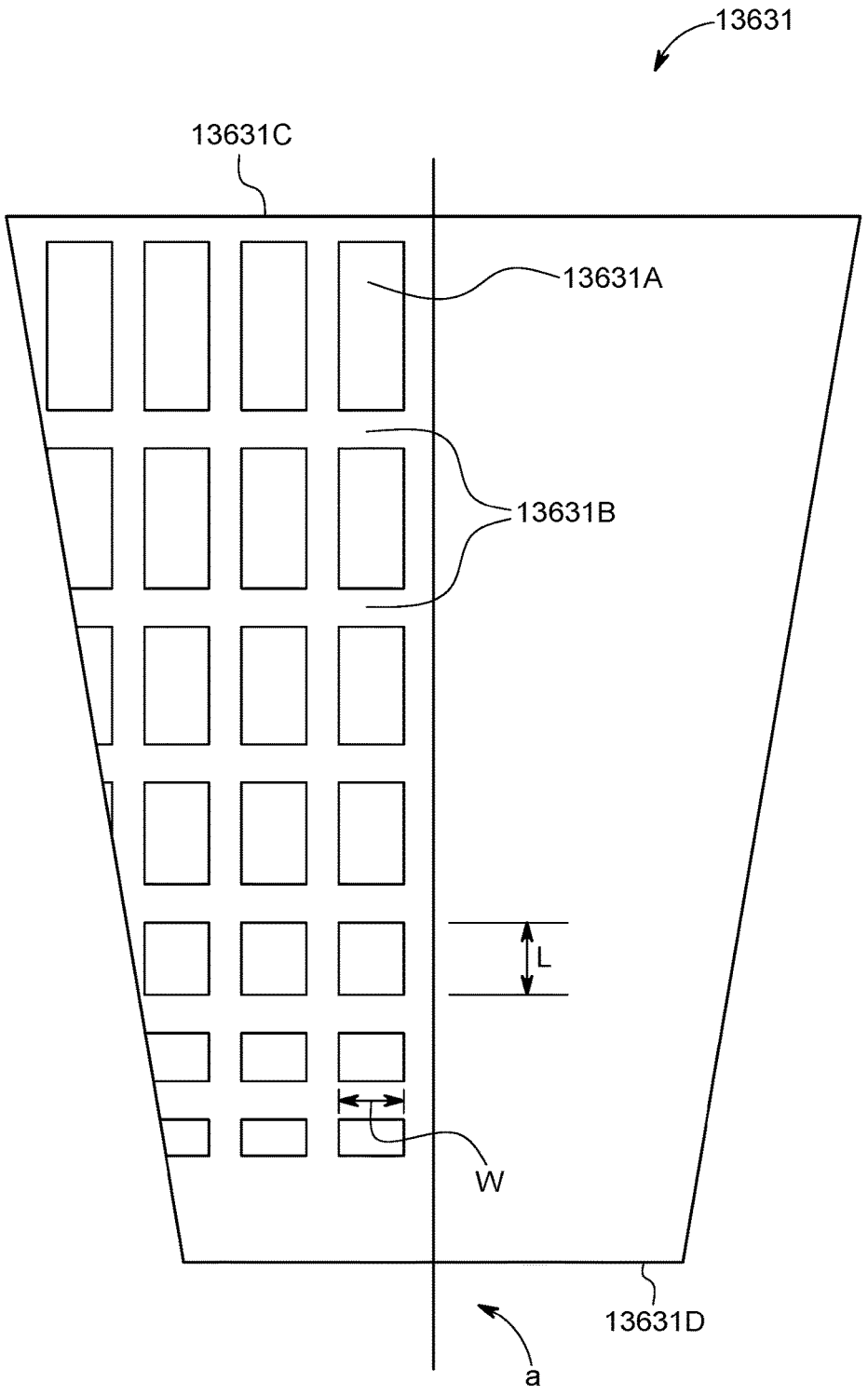
FIG. 9 shows a perforated replaceable insert for a sand separator vessel with slots having a vertical orientation and varying lengths, according to an embodiment of the current application.

FIG. 9 shows a perforated replaceable insert 13631 according to another embodiment of this disclosure. The perforations of the perforated replaceable insert 13631 are vertical slots 13631A with land areas 13631B between the vertical slots 13631A. The vertical slots 13631A are positioned in columns and rows on the perforated replaceable insert 13631.

As with vertical slots 1363A of FIG. 7, vertical slots 13631A may be arranged parallel to a line "a" such that the line "a" is the tangent of the conical axis of the perforated replaceable insert 13631. Similarly to vertical slots 1363A of FIG. 7, vertical slots 13631A of FIG. 9 may have essentially the same width "W." Unlike FIG. 7, vertical slots 13631A of FIG. 9 do not all have the same length "L."

As sand moves vertically downward through the perforated replaceable insert 13631 from the top 13631C to the bottom 13631D, the length "L" of the vertical slots 13631A changes. This change may be longer length "L" at the top 13631C and shorter length "L" at the bottom 13631D (as shown in FIG. 9) of the perforated replaceable insert 13631. It is also possible that the change in the length "L" as the sand moves vertically downward is a gradual change and may not be made in each row.

In another embodiment, the gradual change of the length "L" may occur in sets of rows, for example the first two rows may be a set of rows and the length "L" for each vertical slot 13631A may be the same. Each vertical slot 13631A in a second set of rows, vertically below the first set of rows, may have a different length "L" than the previous set of rows. Other sets of rows may follow and have different lengths "L" from the previous set of rows.

In another embodiment, rows of vertical slots 13631A change gradually in length "L" such that the longest vertical slots are at the bottom (rather than the top) and the top row of vertical slots has the shortest vertical length "L."

Varying the length "L" of the vertical slots may positively impact the sand removal efficiency as larger (or in this case vertically longer) vertical slots are positioned where the highest concentration of sand to be removed exists. In the case of gradually changing vertical slot length "L" dimension, the largest length should not exceed about 100 mm and the smallest "L" dimension should not be less than 5 mm. For example, a maximum length of 50 mm and a minimum length of 10 mm would be suitable. These ranges of length "L" dimensions will prevent passage of wood chips, pin chips, fines, pulp fibers or other matter other than sand from passing through the vertical slot.

Figure 10:
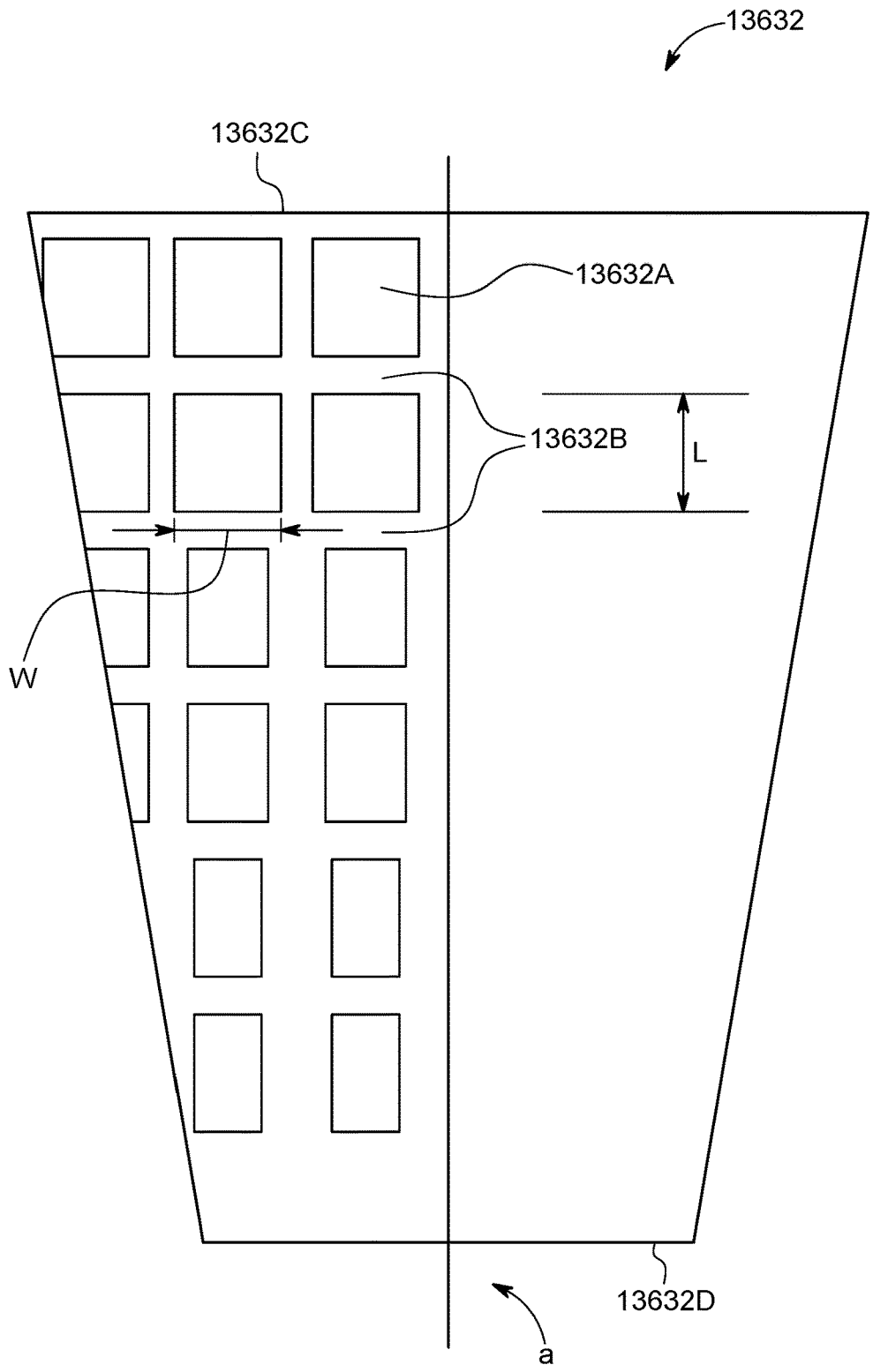
FIG. 10 shows a perforated replaceable insert for a sand separator vessel with slots having a vertical orientation and varying lengths and widths, according to an embodiment of the current application.

FIG. 10 shows a perforated replaceable insert 13632 according to another embodiment of this disclosure. The perforations of the perforated replaceable insert 13632 are vertical slots 13632A and have land areas 13632B between the vertical slots 13632A. The vertical slots 13632A are positioned in columns and rows on the perforated replaceable insert 13632.

As with vertical slots 1363A of FIG. 7, vertical slots 13632A may be arranged parallel to a line "a" such that the line "a" is the tangent of the conical axis of the perforated replaceable insert 13632. Unlike vertical slots 1363A of FIG. 7, vertical slots 13632A of FIG. 10 do not have essentially the same width "W" or length "L."

As sand moves vertically downward through the perforated replaceable insert 13632 from the top 13632C to the bottom 13632D, both the length "L" and width "W" of the vertical slots 13632A change. This change may be longer length "L" and wider width "W" at the top 13632C and shorter length "L" and narrower width "W" at the bottom 13632D (as shown in FIG. 10) of the perforated replaceable insert 13632. In some embodiments the change in the length "L" and width "W" as the sand moves vertically downward is a gradual change and may not be made in each row. In another embodiment the gradual change of the length "L" and width "W" may occur in sets of rows, for example the first two rows may be a set of rows and the length "L" and width "W" for each vertical slot 13632A may be the same. Each vertical slot 13632A in a second set of rows, vertically below the first set of rows, may have a different length "L" and width "W" than the previous set of rows. Other sets of rows may follow and have different lengths "L" and widths "W" from the previous set of rows.

In some embodiments rows of vertical slots 13632A have a gradual change in the length "L" and width "W" such that the longest and widest vertical slots are at the bottom (rather than the top) and the top row of vertical slots has the shortest and narrowest vertical slot dimension.

While not shown in any of FIGS. 7 to 10, it is also possible for the rows and columns of vertical slots to have an angle, relative to line "a," of 15 degrees to 185 degrees, for example: 30 degrees to 150 degrees, 45 degrees to 135 degrees, 60 degrees to 120 degrees, 15 degrees to 60 degrees or even 120 degrees to 185 degrees would be suitable. The range of angles chosen corresponds with the flow pattern of the sand as it moves vertically downward in the sand separator vessel. The flow pattern of the sand is a function of multiple factors: the dimensions of the sand separator vessel, the volume of entrained liquor entering the sand separator vessel, and the concentration of sand in the entrained liquor. By observing the flow of sand downward through the sand separator vessel, the angle can be set. The angle used would depend on the dimensions of the region and the volume of entrained liquid fed to the vessel.

Presented in this disclosure is: a sand separator vessel to separate entrained liquor into solid particles (essentially sand) and an essentially sand free (cleaned) liquor stream. The sand separator vessel comprises at least an upper section of the cylindrical portion and at least a lower section; a tangential inlet to the upper section of the cylindrical portion to accept the entrained liquor; an outlet at the top of the cylindrical portion to discharge the essentially sand free (cleaned) liquor; an outlet at the bottom of the lower section to discharge the solid particles; the lower section having a conical portion. The conical potion has a conically shaped replaceable insert surrounded by a solids particle collection region. The conically shaped replaceable insert is a metal plate with perforations formed into a conical shape sized to fit within the conical portion of the lower section. Perforations in the metal plate are slots having a length "L" and a width "W." The slots are arranged in a pattern of rows and columns such that the columns of slots are parallel to a line formed by the tangent of the conical axis of the replacement insert.

In at least some embodiments, the slots have a gradually changing width "W," a gradually changing slot length "L," a gradually changing slot width "W," and a gradually changing slot length "L."

Presented in this disclosure is a perforated replaceable insert for a separation device. The perforated replaceable insert for the separation device comprises: a metal plate having a conical shape. The conical shape has a larger opening at one end and a smaller opening at the opposite end. Multiple perforations are in the conically shaped metal plate. Each of the multiple perforations has a length "L" and a width "W," the length "L" and width "W" may be different from each other. The multiple perforations may also be slots. The multiple perforations form a pattern of columns and rows in the metal plates; wherein the columns are all placed in a metal plate and the columns of perforations are parallel to a line formed by the tangent of the conical axis of the replacement insert.

In at least some embodiments, the perforated replaceable insert is suitable for use in a sand separator vessel. Additionally, in some embodiments the width "W" of the perforations gradually changes from one end of the replaceable insert to the opposite end of the replaceable insert while the length "L" does not change. In some embodiments, the width "W" of the multiple perforations is no more than 6 mm.

Some embodiments of the perforated replaceable insert may have a hard coating applied to 25% to 30% of the top 1363C, 13630C, 13631C, 13632C end of the conically shaped metal plate where the formed replaceable insert has a larger opening compared to the bottom 1363D, 13630D, 13631D, 13632D. In at least some embodiments, the conically shaped metal plate is thicker at the end where the conically shaped metal plate has the larger opening.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A sand separator vessel to separate entrained liquor into solid particles and an essentially solid particles free liquor stream comprising:

at least an upper section of a cylindrical portion and at least a lower section;

a tangential inlet to the upper section of the cylindrical portion to accept the entrained liquor;

an outlet at the top of the upper section of the cylindrical portion to discharge an essentially solid particles free liquor;

an outlet at the bottom of the lower section to discharge the solid particles;

the lower section having a conical portion;

the conical portion having a conically shaped replaceable insert surrounded by a solid particles collection region;

wherein the conically shaped replaceable insert is a metal plate with perforations in the metal plate, and the metal plate is formed into a conical shape sized to fit within the conical portion of the lower section;

the perforations in the metal plate are slots having a length "L" and a width "W";

the slots are arranged in a pattern of rows and columns such that the columns of slots are parallel to a line formed by the tangent of the conical axis of the replaceable insert.

2. The sand separator vessel of claim 1 wherein the solid particles are sand.

3. The sand separator vessel of claim 2 wherein the slots have a gradually changing width "W".

4. The sand separator vessel of claim 3 wherein the slots have a gradually changing length "L".

5. The sand separator vessel of claim 2 wherein the slots have a gradually changing length "L".

6. The sand separator vessel of claim 2 wherein the maximum width of the slot is 6 mm.

7. The sand separator vessel of claim 1 wherein the replaceable insert has a hard coating applied to the top 25% to 30% of the replaceable insert.

8. The sand separator vessel of claim 1 wherein the metal plate of the replaceable insert has an increased thickness for the top 25% to 30% of the replaceable insert.

9. The sand separator vessel of claim 8 wherein the metal plate is 2 mm to 8 mm thicker.

10. The sand separator vessel of claim 8, wherein the thickness of the metal plate is increased by 10% to 20%.

11. A perforated replaceable insert for a separation device comprising:

a metal plate having a conical shape, and wherein the conical shape has a larger opening at one end and a smaller opening at the opposite end, and multiple perforations in the conically shaped metal plate, wherein each of the multiple perforations has at least a length "L" and a width "W," and the multiple perforations form a pattern of columns and rows in the metal plate, wherein the columns are all placed in the metal plate and the columns of perforations are parallel to a line formed by the tangent of the conical axis of the replaceable insert.

12. The perforated replaceable insert of claim 11, wherein said insert is suitable for use in a sand separator vessel.

13. The perforated replaceable insert of claim 11, wherein the perforations are slots.

14. The perforated replaceable insert of claim 11, wherein the width "W" of the perforations gradually changes from one end to the opposite end while the length "L" does not change.

15. The perforated replaceable insert of claim 11, wherein a hard coating is applied to 25% to 30% of the conically shaped metal plate at the end having the larger opening.

16. The perforated replaceable insert of claim 11, wherein the conically shaped metal plate is thicker at the end having the larger opening.

17. The perforated replaceable insert of claim 11, wherein the width "W" of the perforations is no greater than 6 mm.

* * * * *